United States Patent [19]

Schroeder

[11] Patent Number: 4,726,883

[45] Date of Patent: Feb. 23, 1988

[54] APPARATUS FOR SELECTIVELY MOVING THE SLICE LIP OF A HEADBOX

[75] Inventor: Robert W. Schroeder, Beloit, Wis.

[73] Assignee: Beloit Corporation, Beloit, Wis.

[21] Appl. No.: 43,903

[22] Filed: Apr. 27, 1987

[51] Int. Cl.[4] ..... D21F 1/06

[52] U.S. Cl. ..... 162/259; 162/262; 162/344; 162/347

[58] Field of Search ..... 162/344–347, 162/336, 259, 262; 425/466

[56] References Cited

U.S. PATENT DOCUMENTS

| | | | |
|---|---|---|---|
| 3,413,192 | 11/1968 | Beecher | 162/259 |
| 4,514,348 | 4/1985 | Iguchi et al. | 425/466 |
| 4,517,056 | 5/1985 | Roerig et al. | 162/344 |
| 4,526,654 | 7/1985 | Johansson et al. | 162/347 |

OTHER PUBLICATIONS

Garnett, "Gaining an Edge: CD Profile Control at the Headbox", PIMA, Feb. 1984, pp. 19–23.

*Primary Examiner*—Peter Chin
*Assistant Examiner*—K. M. Hastings
*Attorney, Agent, or Firm*—Dirk J. Veneman; Raymond W. Campbell; David J. Archer

[57] ABSTRACT

An apparatus is disclosed for selectively moving the slice lip of a headbox of a papermaking machine. The apparatus includes a housing secured to the headbox with the housing defining an elongate chamber. A control rod has a first and a second end with the first end being connected to the slice lip and the second end defining a longitudinally-threaded surface. A rotatable member is disposed within the chamber, the rotatable member defining an internally-threaded bore which cooperates with the threaded surface of the control rod such that when the member rotates within the chamber, the control rod is moved axially relative to the housing for selectively moving the slice lip. A motor is rigidly secured to the housing and is drivingly connected to the rotatable member for selectively rotating the rotatable member relative to the housing. The motor and the rotatable member are coaxial such that the apparatus is of compact configuration so that the space required by the apparatus is reduced and a larger number of control rods may be disposed in side-by-side relationship in a cross-machine direction such that the controllability of the slice lip is increased.

12 Claims, 2 Drawing Figures

APPARATUS FOR SELECTIVELY MOVING THE SLICE LIP OF A HEADBOX

BACKGROUND OF THE INVENTION

Field of the Invention

This invention relates to an apparatus for selectively moving the slice lip of a headbox of a papermaking machine. More specifically, this invention relates to an in-line apparatus of compact configuration for controlling the slice lip of a headbox.

INFORMATION DISCLOSURE STATEMENT

In the papermaking art, stock is ejected from a headbox onto the upper surface of a rapidly moving forming wire where the deposited stock is dewatered. The resultant formed web is then successively pressed, dried and calendered.

In order to produce a web having the required characteristics, it is essential that the jet of stock ejected from the headbox be accurately controlled. To control this jet of stock, a slice lip is provided at the outlet of the headbox with the slice lip extending across the headbox in a cross-machine direction. A plurality of control rods is secured along the cross-machine direction of the slice lip such that by moving the axial disposition of these control rods, the cross-machine profile of the outlet of the headbox can be controlled. This controllability enables the operator to control the cross-machine profile of the resultant web.

In the prior art, each of the control rods was adjusted manually by means of various rack and pinion, or worm gear, configurations such that each control rod could be individually positioned to provide an optimum setting of the slice lip.

More recently, such manual adjustment has been superseded by motorized means with the rotary axis of the motor being disposed, usually at right angles, to the longitudinal axis of the control rod with suitable gearing being disposed between the motor and the control rod for positioning the slice lip. In some of the prior art proposals, each of these motors has been connected to computerized control means such that each portion of the slice lip in a cross-machine direction may be accurately positioned to produce a web having a uniform caliper along the cross-machine direction.

Due to the disposition of the prior art motors at right angles to the control rods, problems have arisen because—first, these motors, due to the limited space above the headbox, have protruded over the forming wire thereby exposing the motor to the deleterious effects of moisture and splashing. Second, and more importantly, such disposition of the motors and associated gears has meant that the minimum distance between adjacent motors has been in the region of four and one-half inches. Therefore, the number of motors and corresponding control rods for a given headbox width was limited, thus limiting the overall controllability of the slice lip.

The present invention seeks to overcome the aforementioned inadequacies of the prior art proposals by providing an in-line apparatus in which the rotary axis of the motor is disposed coaxial with the control rod thereby preventing overhang of the motor over the wire and also providing an apparatus of compact configuration such that for a given headbox width, more control rods for the slice lip may be provided resulting in a more accurate control of the profile of the resultant web.

Another object of the present invention is the provision of an apparatus for selectively moving the slice lip of a headbox in which a rotatable member threadably cooperates with a control rod such that rotation of the rotatable member causes axial movement of the control rod.

Another object of the present invention is the provision of an apparatus in which an electric motor has a rotary axis which is coaxial to the longitudinal axis of the control rod for preventing overhang of the motor over the forming wire.

Another object of the present invention is the provision of an apparatus in which the electric motor and the control rod are coaxial, thereby minimizing the space required by each apparatus in a cross-machine direction resulting in increased controllability of the cross-machine profile of the web.

Another object of the present invention is the provision of an orifice which permits access to the motor such that the disposition of the control rod can be adjusted manually.

Another object of the present invention is the provision of an apparatus including a meter connected to an axially-movable collar for giving a positive indication of the actual disposition of the control rod.

Other objects and advantages of the present invention will be apparent to those skilled in the art by a consideration of the following detailed description taken in conjunction with the annexed drawings and also by consideration of the appended claims which define the scope of this invention.

SUMMARY OF THE INVENTION

This invention relates to an apparatus for selectively moving the slice lip of a headbox for a papermaking machine. The apparatus includes a housing which is secured to the headbox, the housing defining an elongate chamber. A control rod has a first and a second end with the first end being connected to the slice lip and the second end defining a longitudinally-threaded surface. A rotatable member is disposed within the chamber with the rotatable member defining an internally-threaded bore which cooperates with the threaded surface such that when the member rotates within the chamber, the control rod is moved axially relative to the housing for selectively moving the slice lip. A rotary means is rigidly secured to the housing and drivingly-connected to the rotatable member for selectively rotating the rotatable member relative to the housing. The rotary means and the rotatable member are coaxial such that the apparatus is compact so that the space required by the apparatus is reduced and a larger number of control rods disposed in a side-by-side relationship may be provided along the cross-machine direction of the slice lip thereby increasing the controllability of the slice lip.

In a more specific embodiment of the present invention, the housing includes a first, second, third and fourth part thereof, with the first part rotatably supporting the rotatable member. The first part also includes a radially-extending flange defining holes for fastening the housing to the headbox. Additionally, the first part also includes a first and second taper bearing disposed within the chamber for rotatably supporting the rotatable member.

The second part of the housing threadably cooperates with the first part of the housing with the second part having a first and a second end. The first end of the second part is connected to the first part and the second end of the second part is rigidly secured to the rotary means.

The third part of the housing has a first and a second end with the first end being removably connected to the second end of the second part of the housing. The second end of the third part of the housing defines an orifice which permits access to the rotary means such that the disposition of the control rod may be manually adjusted.

The fourth part of the housing is rigidly connected to the first part of the housing with the fourth part also including a meter for permitting the reading of the actual disposition of the control rod relative to the housing.

The control rod extends from the slice lip through an opening defined by the housing such that when the rotatable member rotates, the control rod moves axially relative to rotatable member through the opening.

The rotatable member defines an external longitudinal threaded portion. This rotatable member also includes an internally-threaded collar which threadably engages and cooperates with the external threaded portion of the rotatable member. Means extend through the housing and cooperate with the collar for preventing rotation of the collar relative to the housing. The means permits the collar to move axially relative to the rotatable member such that when the rotatable member rotates relative to the housing, the collar moves axially relative to the housing. The collar also defines a truncated, conical external surface with the conical surface cooperating with a plunger of a meter such that actual movement of the collar relative to the housing results in actuation of the meter for providing a direct reading of the actual disposition of the control rod relative to the housing.

The rotary means includes an electrically-powered motor and a gear box drivingly connected to the motor, the gear box being drivingly connected to the rotatable member. The motor is disposed coaxially relative to the control rod and the gear box includes an input and an output. A plurality of planatary gears is disposed between the input and the output such that in use of the apparatus, for every revolution of the motor, the output from the gear box is reduced so that for every 50–75 revolutions of the output of the gear box, the control rod moves approximately one thousandth of an inch in an axial direction. The motor is reversible and the gear box output shaft defines an external spline. An internally-splined nut cooperates with the external spline such that the nut slides axially and is rotatably driven by the output shaft. The nut defines a hexagonal outer surface which cooperates with hexagonal bore defined by a coupling sleeve. The rotatable member defines a hexagonal outer surface of the same dimensions as the hexagonal surface of the nut such that the hexagonal surface of the rotatable member slides within the sleeve such that rotation of the motor causes rotation of the rotatable member.

Although the detailed description discloses the preferred embodiment of the present invention, it will be evident to those skilled in the art that many variations and modifications of the present invention may be made and that these variations and modifications fall within the spirit and scope of the present invention as defined by the appended claims. Included among these modifications is the provision of an apparatus that does not include a mechanically-operated meter but rather, a proximity detector or the like. Furthermore, such modifications include the provision of a manual key with gearing for insertion through the orifice for permitting manual adjustment of the control rod or the provision of a powered tool having a digital readout for individually adjusting each control rod to the desired disposition thereof. Alternately, a second gearbox is disposed between the orifice and the electric motor so that when a manual screwdriver or the like is inserted through the orifice for driving the second gearbox, the second gearbox causes rapid rotation of the motor for moving the control rod axially without energizing the motor. Also, the rotatable member may be of the split nut type for inhibiting backlash as featured in the Duff-Norton Series 1800 worm gear arrangement.

DETAILED DESCRIPTION OF THE DRAWINGS

Figure 1:
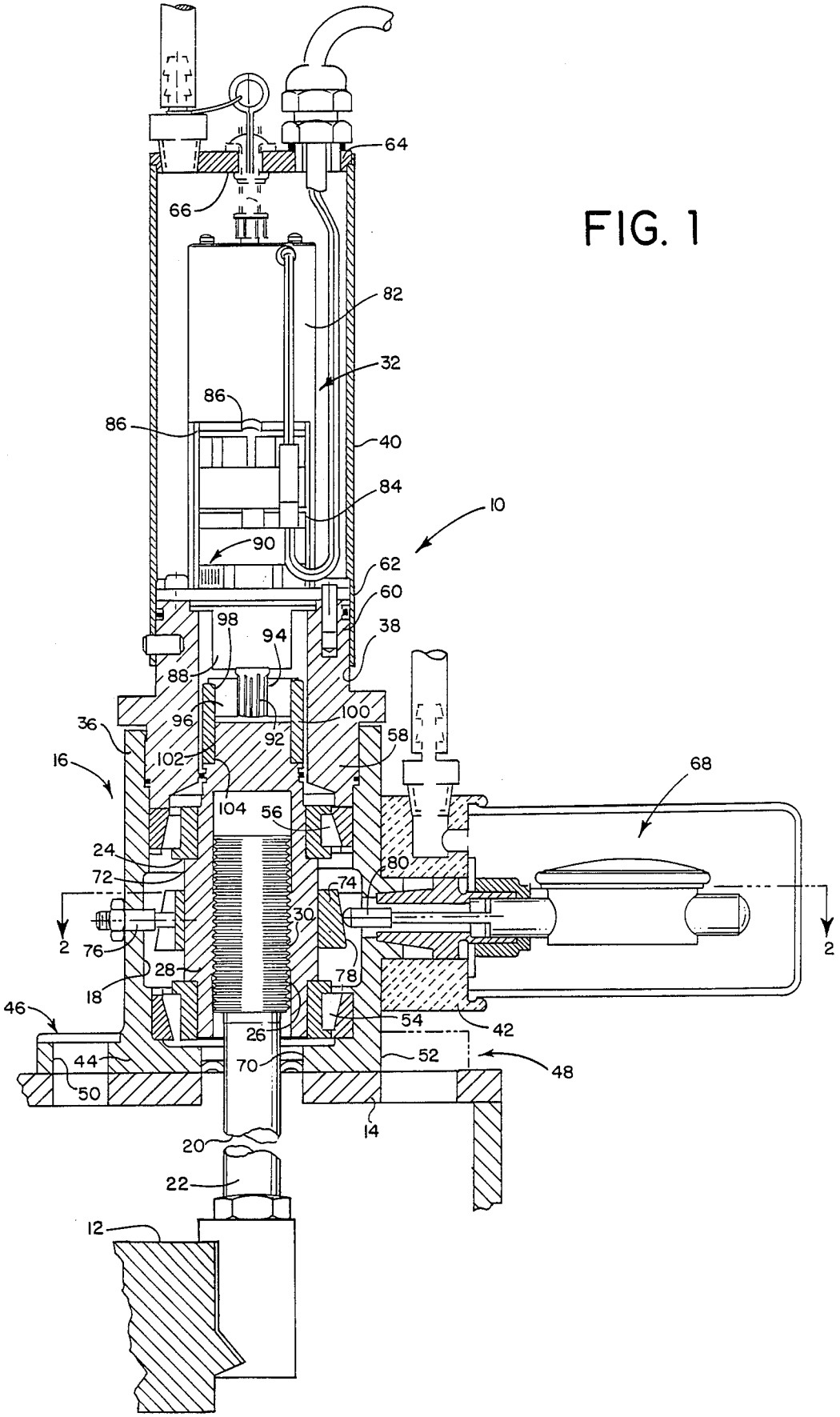
FIG. 1 is a side sectional view of the apparatus according to the present invention.
Figure 2:
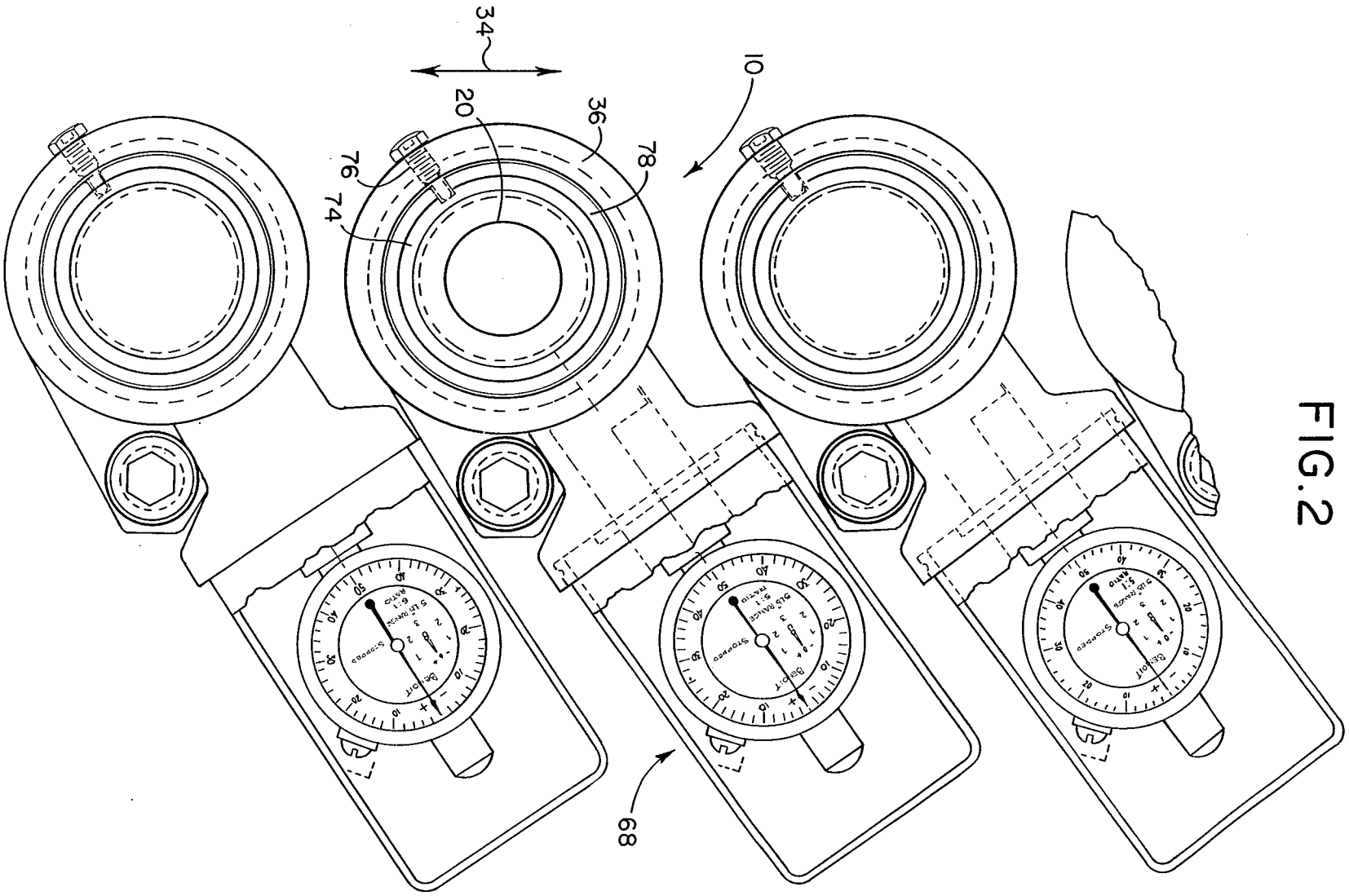
FIG. 2 is a sectional view taken on the line 2—2 of FIG. 1 showing the side-by-side relationship of a plurality of apparatus according to the present invention.

FIG. 1 is a side sectional view of the apparatus generally designated 10 for selectively moving the slice lip 12 of a headbox 14 of a papermaking machine. The apparatus 10 includes a housing generally designated 16 secured to the headbox 14. The housing 16 defines an elongate chamber 18. A control rod 20 has a first and a second end 22 and 24. The first end 22 of the control rod 20 is connected to the slice lip 12. The second end 24 of the control rod 20 defines a longitudinally-threaded surface 26. A rotatable member 28 is disposed within the chamber 18. The rotatable member 28 defines an internally-threaded bore 30 which cooperates with the threaded surface 26 such that when the member 28 rotates within the chamber 18 the control rod 20 is moved axially relative to the housing 16 for selectively moving the slice lip 12. A rotary means generally designated 32 is rigidly secured to the housing 16 and is drivingly connected to the rotatable member 28 for selectively rotating the member 28 relative to the housing 16. The rotary means 32 and the rotatable member 28 are coaxial such that the apparatus 10 is compact so that the space required by the apparatus 10 is reduced and a larger number of control rods disposed in side-by-side relationship (as shown in FIG. 2) may be provided along the cross-machine direction indicated by the arrow 34 thereby increasing the controllability of the slice lip 12.

More particularly, as shown in FIG. 1, the housing includes a first, second, third and fourth part 36,38,40 and 42 respectively. The first part 36 rotatably supports the rotatable member 28. The first part 36 also includes a radially-extending flange 44 with the flange 44 including means 46 and 48 for fastening the first part 36 of the housing 16 to the headbox 14. The fastening means 46 and 48 includes two holes 50 and 52 defined by the flange 44 for fastening the first part 36 of the housing 16 to the headbox 14. The first part 36 of the housing 16 also includes a first and a second taper bearing 54 and 56 which are disposed within the chamber 18 such that the rotatable member 28 rotates within the first part 36 of the housing 16.

The second part 38 of the housing 16 threadably cooperates with the first part 36 of the housing. The second part 38 has a first and a second end 58 and 60 respectively with the first end 58 being connected to the first part 36 and the second end 60 being rigidly secured to the rotary means 32.

The third part 40 of the housing 16 has a first and a second end 62 and 64 respectively. The first end 62 is removably connected to the second end 60 of the second part 38. The second end 64 of the third part 40 defines an orifice 66 which permits access to the rotary means 32 for manually adjusting the control rod 20. The third part 40 of the housing 16 covers the rotary means 32.

The fourth part 42 of the housing 16 is rigidly connected to the first part 36 with the fourth part 42 further including a meter generally designated 68 for permitting the reading of the actual disposition of the control rod 20 relative to the housing 16.

The control rod 20 extends from the slice lip 12 through an opening 70 defined by the housing 16 such that when the rotatable member 28 rotates, the control rod 20 moves axially relative to the rotatable member 28 through the opening 70.

The rotatable member 28 defines an external longitudinally-threaded portion 72. The rotatable member 28 also includes an internally-threaded collar 74 which threadably engages and cooperates with the external threaded portion 72 of the rotatable member 28. Means such as a set screw 76 extend through the housing 16 and cooperate with the collar 74 for preventing rotation of the collar 74 relative to the housing 16. The means 76 permit the collar 74 to move axially relative to the rotatable member 28 such that when the rotatable member 28 rotates relative to the housing 16 the collar 74 moves axially relative to the housing 16. The collar 74 defines a truncated, conical external surface 78. The conical surface 78 cooperates with a plunger 80 of the meter 68 such that axial movement of the collar 74 relative to the housing 16 results in actuation of the meter 68 for providing a reading of the actual disposition of the control rod 20 relative to the housing 16.

As shown in FIG. 1, the rotary means generally designated 32 also includes an electrically-powered motor 82 and a gear box 84 drivingly connected to the motor 82. The gear box 84 is drivingly connected to the rotatable member 28. The motor 82 is disposed coaxial relative to the control rod 20. The gear box 84 also includes an input and an output 86 and 88 respectively. A plurality of planetary gears generally designated 90 is disposed between the input and output 86 and 88 respectively such that in use of the apparatus 10, for every revolution of the motor 82 the output 88 from the gear box 84 is reduced so that for every 50–75 revolutions of the input 86 or, in a specific embodiment, for every 66 revolutions of the input 86 of the gear box 84 the control rod 20 moves one thousandth of an inch in an axial direction. The motor 82 is reversible and the output 88 of the gear box 84 also includes a gear box output shaft 92 which defines an external spline 94. An internally-splined nut 96 cooperates with the external spline 94 such that the nut 96 slides axially and is rotatably driven by the output shaft 92. The nut 96 defines a hexagonal outer surface 98. A coupling sleeve 100 defines a hexagonal bore 102 for cooperating with the hexagonal outer surface 98 of the nut 96. The rotatable member 28 defines a hexagonal outer surface 104 of the same dimensions as the hexagonal surface 98 of the nut 96 such that the hexagonal surface 104 of the rotatable member 28 slides within the sleeve 100 such that rotation of the motor 82 causes rotation of the rotatable member 28.

In operation of the apparatus 10, the electric motor 82 is energized. Output from the electric motor 82 is reduced through the planetary gear box 84 such that the nut 96 rotates at a slower speed than the rotational speed of the electric motor 82. Rotation of the nut 96 is transmitted to the rotatable member 28 by means of the sleeve 100. Rotation of the rotatable member 28 causes the control rod 20 to move axially towards, or away from, the electric motor 82. This axial movement of the control rod 20 directly controls the disposition of the slice lip 12 thereby controlling the cross-machine profile of the resultant web.

The present invention provides an in-line apparatus for controlling the position of a control rod for a slice lip of a headbox such that the actuating motor is not disposed above the forming wire. More particularly, the present invention provides a compact arrangement which permits the provision of a greater number of control rods in a cross-machine direction than was previously possible with the prior art offset actuating motors.

What is claimed is:

1. In a papermaking machine headbox with a slice lip, an apparatus for selectively moving the slice lip of the headbox of the papermaking machine, said apparatus comprising a plurality of adjustment mechanisms spaced along the cross-machine direction of the slice lip, each adjustment mechanism comprising:

a housing secured to the headbox, said housing defining an elongate chamber;

a control rod having a longitudinal axis and a first and a second end, said first end being connected to the slice lip;

a rotatable member disposed within said chamber, said rotatable member threadably cooperating with said second end of said control rod such that when said member rotates within said chamber, said control rod is moved axially relative to said housing for selectively moving the slice lip; and an electric motor having a rotary axis and rigidly connected to said housing and drivingly connected to said rotatable member for selectively rotating said rotatable member relative to said housing, the rotary axis of said motor being coaxial with the longitudinal axis of said control rod such that the apparatus is compact so that the space required by the apparatus is reduced and a larger number of control rods disposed in side-by-side relationship may be provided along the cross-machine direction of the slice lip thereby increasing the controllability of the slice lip.

2. An apparatus as set forth in claim 1 wherein said housing includes:

a first, second, third and fourth part thereof;

said first part rotatably supporting said rotatable member;

said first part further including: a radially-extending flange, said flange defining means for fastening said first part of said housing to the headbox.

3. An apparatus as set forth in claim 2 wherein said first part further includes:

a first and second taper bearing disposed within said chamber such that said rotatable member rotates coaxially within said first part of said housing.

4. An apparatus as set forth in claim 2 wherein:

said second part of said housing threadably cooperates with said first part of said housing, said second part having a first and a second end;

said first end being connected to said first part, said second end being rigidly secured to said electric motor.

5. An apparatus according to claim 4 wherein:

said third part of said housing has a first and a second end, said first end being removably connected to said second end of said second part, said second end of said third part defining an orifice which permits access to the electric motor for manual adjustment of said control rod, said third part of said housing covering said electric motor.

6. An apparatus as set forth in claim 2 wherein:

said fourth part of said housing is rigidly connected to said first part, said fourth part further including:

a meter for permitting the reading of the actual disposition of said control rod relative to said housing.

7. An apparatus as set forth in claim 1 wherein:

said control rod extends from the slice lip through an opening defined by said housing such that when said rotatable member rotates, said control rod moves axially relative to said rotatable member through said opening.

8. An apparatus as set forth in claim 1 wherein:

said rotatable member defines an external longitudinally threaded portion;

said rotatable member further including: an internally-threaded collar which threadably engages and cooperates with said external threaded portion of said rotatable member;

means extending through said housing and cooperating with said collar for preventing rotation of said collar relative to said housing, said means permitting said collar to move axially relative to said rotatable member such that when said rotatable member rotates relative to said housing, said collar moves axially relative to said housing;

said collar defining a truncated, conical external surface, said conical surface cooperating with a plunger of a meter such that axial movement of said collar relative to said housing results in actuation of said meter for providing a reading of the actual disposition of said control rod relative to said housing.

9. An apparatus as set forth in claim 1 wherein each adjustment mechanism further comprises:

a gear box drivingly connected to said motor, said gear box being drivingly connected to said rotatable member.

10. An apparatus as set forth in claim 9 wherein said gear box further includes:

an input and an output;

a plurality of planetary gears disposed between said input and output such that, in use of the apparatus, for every revolution of said motor, said output from said gear box is reduced so that for every 50–75 revolutions of said input of said gear box, said control rod moves approximately one-thousandth of an inch in an axial direction.

11. An apparatus as set forth in claim 1 wherein said motor is reversible.

12. An apparatus as set forth in claim 10 wherein said output of said gear box further includes:

a gear box output shaft which defines an external spline;

an internally splined nut which cooperates with said external spline such that said nut slides axially, and is rotatably driven, by said output shaft, said nut defining a hexagonal outer surface;

a coupling sleeve defining a hexagonal bore for cooperating with said hexagonal outer surface of said nut;

said rotatable member defining a hexagonal outer surface of the same dimensions as said hexagonal surface of said nut such that said hexagonal surface of said rotatable member slides within said sleeve such that rotation of said motor causes rotation of said rotatable member.

* * * * *